United States Patent [19]

Han

[11] Patent Number: 4,691,890

[45] Date of Patent: Sep. 8, 1987

[54] RECLINER

[76] Inventor: Myong-ja Han, 170-47, Kaebong-Dong, Kuro-Ku, Seoul, Rep. of Korea

[21] Appl. No.: 827,304

[22] PCT Filed: Apr. 16, 1985

[86] PCT No.: PCT/KR85/00008

§ 371 Date: Jan. 24, 1986

§ 102(e) Date: Jan. 24, 1986

[87] PCT Pub. No.: WO85/05542

PCT Pub. Date: Dec. 19, 1985

[30] Foreign Application Priority Data

May 26, 1984 [KR] Rep. of Korea ..... 84-4902

[51] Int. Cl.[4] ..... F16M 11/00

[52] U.S. Cl. ..... 248/412; 248/397; 297/375

[58] Field of Search ..... 248/161, 412, 411, 414, 248/394; 296/65 R; 297/375

[56] References Cited

FOREIGN PATENT DOCUMENTS 5038248 of 0000 Japan ..... 248/394
5017688 of 0000 Japan ..... 248/394
1138172 12/1968 United Kingdom ..... 248/412

*Primary Examiner*—Carl D. Friedman
*Assistant Examiner*—Naoko N. Slack
*Attorney, Agent, or Firm*—Armstrong, Nikaido, Marmelstein & Kubovcik

[57] ABSTRACT

A locking device for adjusting an angle or height of two parts of a seat comprises a housing, a rod slidable within the housing, a push rod with a spring to urge it forward, a spring cylinder, a cylindrical collet able to be compressed inwardly thereby engaging the spring cylinder with its cleaved portion, a cone fixed at the forward end of the push rod, moveable within the collet, a second spring biasing the cone, and drive means for driving the push rod along the housing. When the cone engages the collet by action of the second spring, the collet abuts the cylinder, thereby locking the rod and housing together. When the cone disengages from the collet, the collet is released from the spring cylinder by its own resilient force thereby releasing the rod from the housing.

6 Claims, 10 Drawing Figures

RECLINER

FIELD OF INVENTION

This invention relates to a recliner which enables to adjust vertically and angularly the back plate and seat plate of chairs which are installed not only in express buses, passenger cars, trains, airplanes and ships, but also in offices and homes.

In the standing life of present time, the comfort of chairs became an important factor in dissipating the stress and tiredness of the human body. The comfortability of a chair largely depends on the cushion of the chair and on the angular adjustability of the back plate, while the height of the seat plate will have to be adjustable in order to accommodate a wide range of sizes of the human body.

That is, chairs should be such that the angle of the back plate should be adjustable as desired, the feelings on the slope and cushion should be pleasant, the whole product should be durable, should not generate noise due to vibrations, and the height of the seat plate should be adjustable in order to secure a wide range of use.

TECHNICAL BACKGROUND

The conventional recliners have the function of adjustability of the angle of the back plate, but there has been no height adjustability and the cushion of recliner itself. Further, the conventional recliners are divided into the tension type comprising gear and cam, and the compression type comprising hydraulic device and elastic springs; therefore, its attachment location is limited, while the complicatedness of the structure brought difficult in manufacturing and installation. Further still, the conventional recliners had insufficient durability, gave rise to frequency disorders, generated noise due to their clearance and vibrations, while they brought to the users the feeling of non-elastic rigidity and the feeling of abrupt falling sensation, raising unpleasant feelings and adding to the tiredness of the users.

INITIATION OF INVENTION

The present invention provides not only a recliner but also an adjustable seat plate. Its adjustment of the slope is a continuous linear displacement, the halted state is firm, and does not allow any amount of clearance, providing a good security. Also, there is no noise, its movements are smooth, its back plate has a natural cushion generator attached to it, its structures are simplified aimed at lengthening the durability, and diversification of the range of use realizes economy.

The movement of the recliner is controlled by means of the spring cylinder, spiral pipe cylinder, and cushion cylinder, and specifically, as the controlling device, the cone and collet are combined in order for the collet to be engaged or pressed into the spring cylinder, spiral pipe cylinder or cushion cylinder so that movement and halting may be carried out. There are also such structure that button or lever is both pressed in and pulled out. Further in the mutual relationship between the rod and spring cylinder, the dual structure of "pressed-in in the tension state", or "pulled in the pressed-in state" is utilized to diversify the range of use.

THE MOST PREFERRED EMBODIMENT OF THE PRESENT INVENTION

Figure 1:
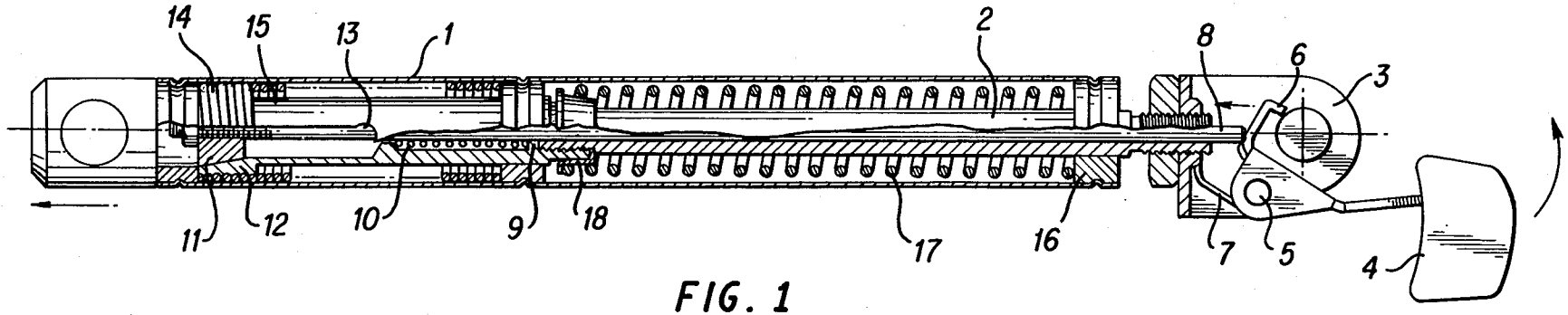
FIG. 1 illustrates the first embodiment of the present invention.

As an example, the housing (1) is fixed on the back plate, and the bracket (3) threadly joined to the rod (2) is secured on the arm rest. When, as in FIG. 1, the back plate is tried to be inclined backward in a state in which the rod (2) is completely inserted into the spring cylinder (10), i.e., in which the back and seat plates of the chair form the right angle, the button should be raised so that the arm (6) may compress the spring (7) by pivoting around arm pin (5), and at the same time, the push rod (or pull rod) (8) (Actually its frontal portion) may be pressed in.

By means of the halting block (9) formed at the middle portion of the push rod (8), the push rod compresses, and at the same time, moves the tapered cone (11) threadly attached on the tip of the rod backward. Accordingly, the cone (11) gets rid of the inside of the collet (12), and the collet (12) is compressed inward due to the cleaved portion (13) and elasticity of itself. Here, the threads (14) on the external circumference of the collet (12) tightly inserted in the spring cylinder (15) is released, and therefore, the collet (12) gains the freedom of movement.

If the back plate is pushed backward in this state, the whole housing (1) moves backward, while the collet (12) moves inside the spring cylinder (15), and the rod cover (16) of the housing (1) is pushed backward along the rod (2). Thereby, the main spring (17) is slowly compressed against the end point of spring seat (18) which is inserted into the centre of the rod (2). Thus when the back plate and the seat plate form the desired angle, and button (4) is released, the force being withdrawn from the back plate, then the movement of the housing (1) is stopped, the button is restored by the force of the spring (7), and at the same time, the push rod (8) released from its pressed-in state is restored by the force of the spring (10). At this time, the cone (11) is inserted back into the inside of the collet (12), which is tapered. Accordingly, the collet is expanded outwardly, and its outside threads are closely engaged with the spring cylinder (15), resulting in the halt of every motion.

On the other hand, in order to restore the back plate, first the human back is withdrawn from the back plate, and the button (14) is raised so that the cone (11) may be disengaged from the collet (12), and the outside threads (14) may be released from the inside of the spring cylinder (15), the housing (1) is restored to its original position by the elastic force of the spring (17).

Figure 5:
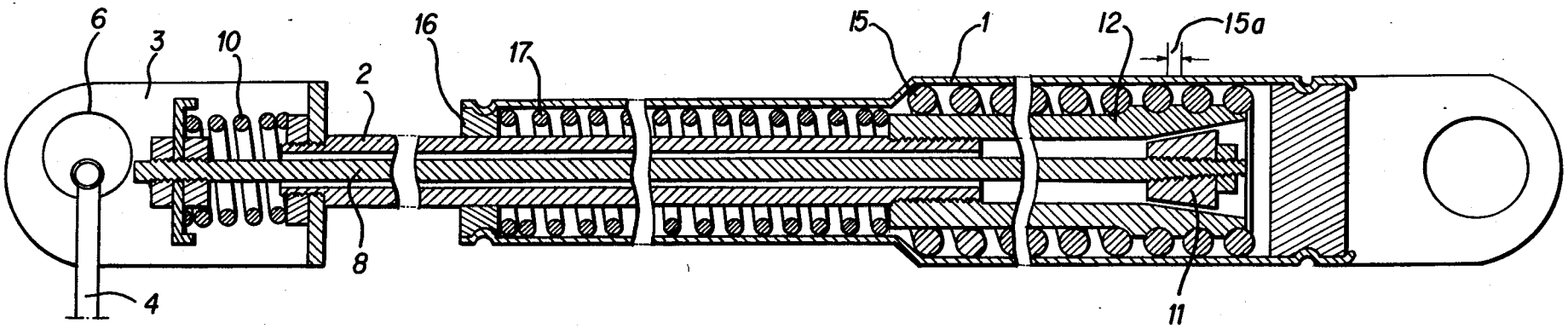
FIG. 5 illustrates the fifth embodiment of the present invention.

If a strong impact is received to the back plate in its locked state, as in the case of some accident, the spring cylinder is elastically compressed as much as its gaps (15*a*) allow, exhibiting a cushion function as in FIG. 5 regardless of collet state.

Figure 2:
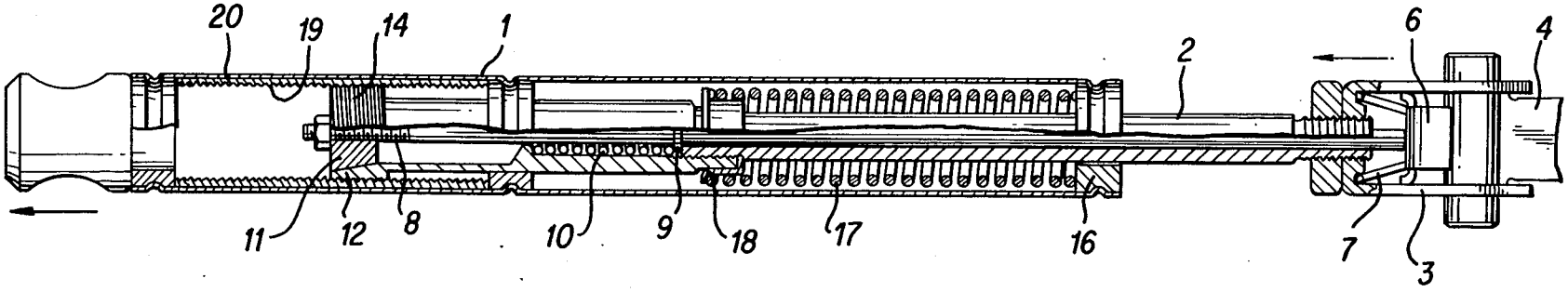
FIG. 2 illustrates the second embodiment of the present invention.

FIG. 2 is a plan view with the rod (2) missing from the housing (1) of FIG. 1, with the modification being that, in the engagement and disengagement of the external threads (14), the spiral pipe cylinder (20) with the inside threads (19) is inserted instead of the spring cylinder of FIG. 1.

Figure 3:
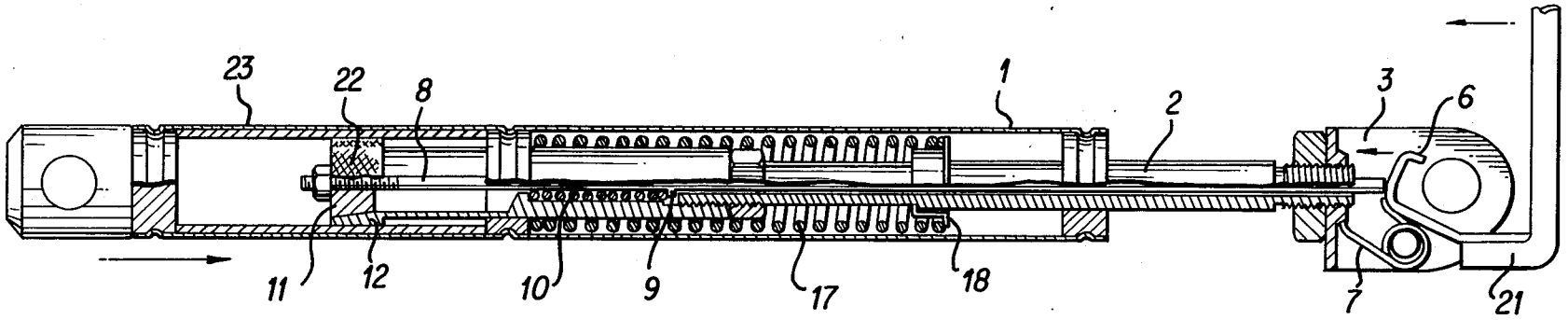
FIG. 3 illustrates the third embodiment of the present invention.

In FIG. 3, the button is replaced with the lever (21), a spiral friction part (22) is formed on the external circumference, and the cushion cylinder (23) is inserted on its outside, forming a structure for stopping by means of the friction resistance of the cushion cylinder (23) and spiral friction part (22). If, at the same time, a force is imposed by fixing the spring seat (18) at the middle portion of the rod (2) in the housing (1), under the state in which the rod (2) is disengaged, then the gap with the bracket (3) is narrowed. Meanwhile, if the cone (11) is released, the gap between the housing (1) and bracket (3) is widened, so that the height of the seat plate of chair may be adjusted or other special functions may be displayed.

Figure 4:
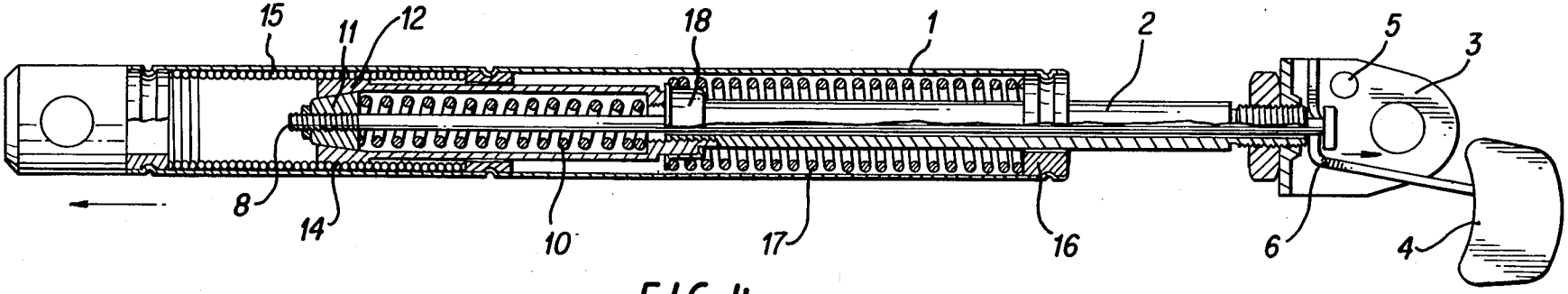
FIG. 4 illustrates the fourth embodiment of the present invention.

FIG. 4 illustrates a state in which the cone (11) and the collet (12) are reversed in their directions, and the restoring spring (10) is elastically inserted inside the collet (12) to push the push rod (8). But the push rod (8) is not pressed in, but is set on a tension state, and therefore, if the cone (11) releases the collet (12), and the button (4) is also released, then the cone (11) and the collet (12) are joined together. Such arrangement is for application to some special case by reversing the movement of the push rod (8).

Figure 6:
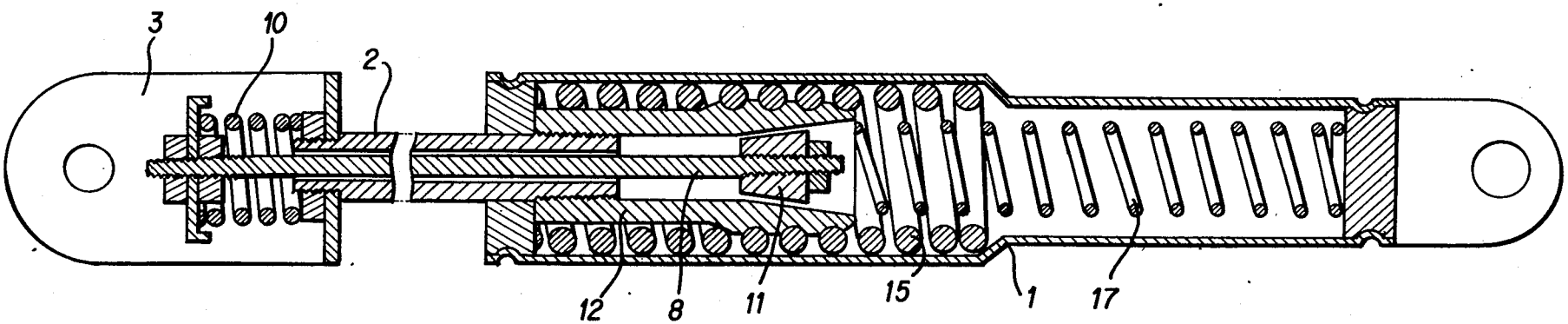
FIG. 6 illustrates the sixth embodiment of the present invention.

FIG. 5 shows a case in which the restoring spring (10) of push rod (8) is installed near the piston bracket. FIG. 6 illustrates a case in which the activating directions of the housing (1) and the rod (2) are reversed, although similar to FIG. 5.

Figure 7A:
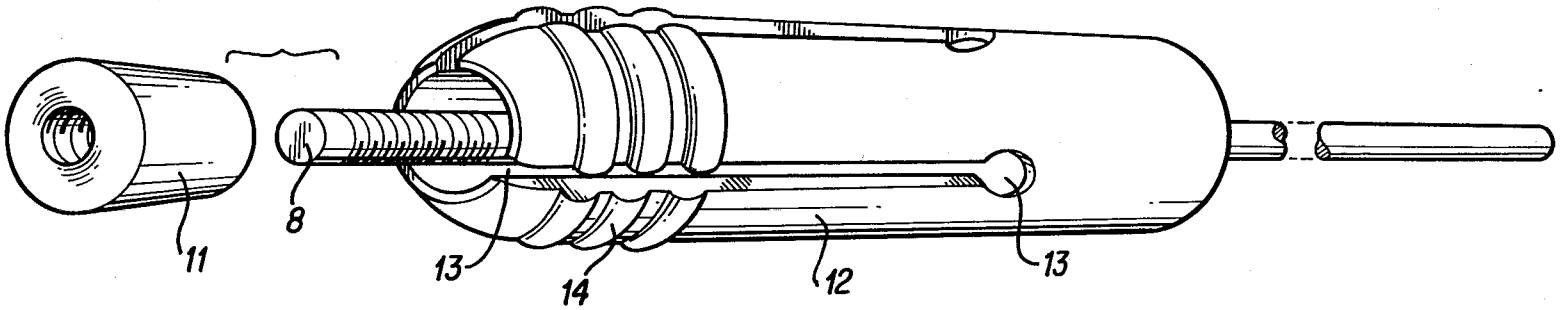
FIG. 7 is a perspective view of the principal parts disassembled.
Figure 7B:
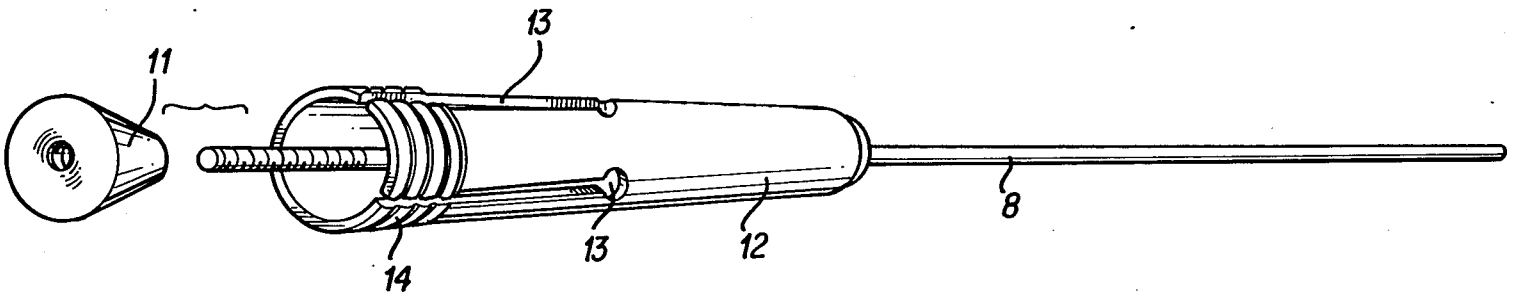

As shown in FIG. 7, the collet (12) is provided with cleaved portion (13) by which the collet has inward elastic forces, and here in FIG. 7, the joining of the taper of the cone (11) and the taper of the collet (12) and the push rod (8) is illustrated.

Figure 10:
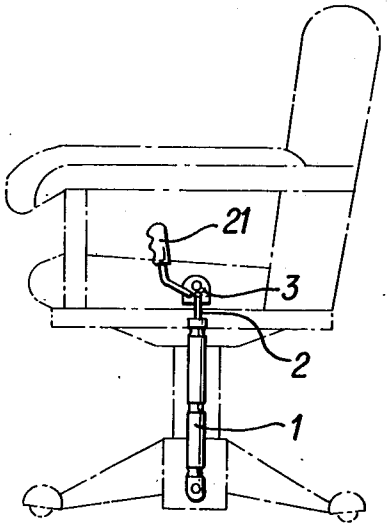
FIGS. 8 to 10 illustrate the location of application.
Figure 9:
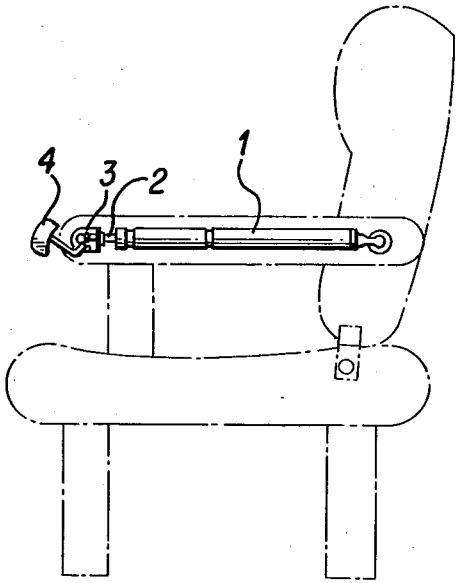
Figure 8:
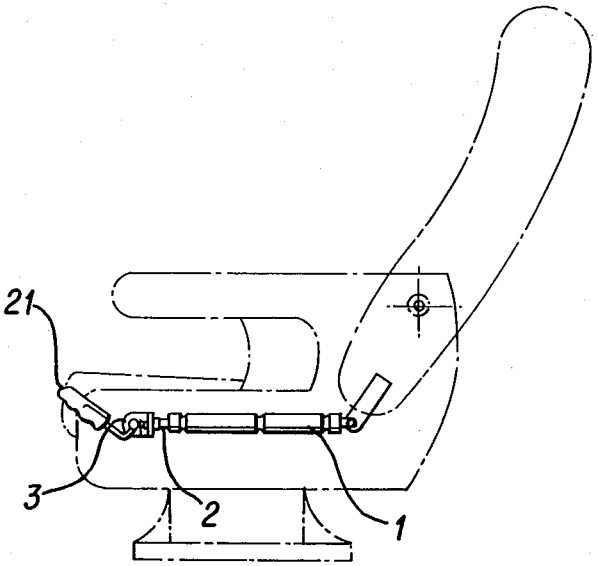

FIGS. 8 through 10 illustrate the application of the recliner, especially the location of the recliner when used. Particularly, FIG. 10 presents the function of the recliner to adjust the height of the seat plate.

USEFULNESS TO THE INDUSTRY

The recliner of the above-described structure according to the present invention has simple structure, consisting of fixing and activating the spring cylinder, is of infinitismal advancement resulting in continuous adjustment function together with self shock-absorbing characteristics, and is provided with the function of adjusting the height of the seat plate, making its device economical, free of disorder, inhibiting clearance so that the noise due to vibrations may be removed.

Therefore, the recliner of the present invention can be applied to chairs used in transportation facilities, in offices and homes usefully, because, based on the human bodily structure, comfortable chairs can be mass produced for extensive distribution in order to alleviate the intensifying human tiredness.

I claim:

1. A locking device for adjusting an angle of height of two parts of a seat comprising:

a housing having a rear end and a forward end, said housing being fixed at first part of said seat;

a rod placed within said housing with a rear end thereof slidably extending from said rear end of said housing, said rear end being fixed at second part of said seat;

a push rod slidably inserted within said rod;

a first spring urging said rod forwardly;

a spring cylinder provided within said forward end of said housing;

a cylindrical collet fixed at the forward end of said rod, said collet having an elasticity to be compressed inwardly and being provided with a cleaved portion and engagement portion at the forward end periphery thereof for engaging said spring cylinder;

a cone fixed at the forward end of said push rod and movable within said collet;

a second spring placed in a space between said push rod and collet biasing said cone, and;

a drive means fixed on said second part of said seat for driving said push rod longitudinally of said housing;

whereby when said cone engages with said collet by the action of said second spring, said forward end periphery of said collet abuts with said cylinder thereby locking said rod and said housing together and, when said cone disengages from said collet, said collet is released from said spring cylinder by its own resilient force thereby releasing said rod from said housing.

2. A locking device according to claim 1, wherein said spring cylinder is a spiral pipe cylinder having internal threads.

3. A locking device according to claim 1, wherein said spring cylinder is a cushion cylinder and said collet is provided with friction spirals around peripheral surface thereof.

4. A locking device according to claim 1, wherein tapering of said cone is such that the diameter of the forward end is smaller than that of rearward end and said second spring is placed within the collet biasing said cone forwardly.

5. A locking device according to claim 1, wherein said drive means is a cam contacting with said push rod and said second spring is placed at the rear end of said push rod.

6. A locking device according to claim 1, wherein said first spring is inserted between the forward end of said housing and the forward end of said collet so that said first spring urges said collet and rod rearwardly.

* * * * *